United States Patent [19]

Godau

[11] Patent Number: 4,501,039

[45] Date of Patent: Feb. 26, 1985

[54] SHEET-DYEING METHOD AND APPARATUS

[76] Inventor: Eckhard Godau, Via Crespera 50, CH-6932 Breganzone, Switzerland

[21] Appl. No.: 514,308

[22] Filed: Jul. 15, 1983

Related U.S. Application Data

[62] Division of Ser. No. 218,817, Dec. 12, 1980, Pat. No. 4,416,124.

[30] Foreign Application Priority Data

Dec. 21, 1979 [DE] Fed. Rep. of Germany ..... 2951695
Dec. 4, 1980 [DE] Fed. Rep. of Germany ..... 3045646
Dec. 4, 1980 [DE] Fed. Rep. of Germany ..... 3045647

[51] Int. Cl.[3] ..... D06B 23/00
[52] U.S. Cl. ..... 8/151.2
[58] Field of Search ..... 68/9, 62, 175, 176, 68/22 R; 8/151.2; 226/109

[56] References Cited

U.S. PATENT DOCUMENTS 3,585,821 6/1971 Beltramini ..... 68/175 X
3,598,226 8/1971 Hayman .

FOREIGN PATENT DOCUMENTS 2174953 10/1973 France .
288112 4/1928 United Kingdom ..... 68/175
1430154 3/1976 United Kingdom ..... 68/175

*Primary Examiner*—Philip R. Coe
*Attorney, Agent, or Firm*—Karl F. Ross; Herbert Dubno

[57] ABSTRACT

A textile sheet strand is dyed by conducting it in at least two separate passes around an annular path having a first path section in a dye vat and a section path section in a gas-treatment location. In the dye vat the strand is contacted with a liquid dye bath in each of the paths, and the excess dye is squeezed out of at least two of the passes at the same time by pinch rollers immediately downstream of the dye vat. In the gas-treatment location the passes of the strand are each treated with a gas to fix the dye.

1 Claim, 7 Drawing Figures

SHEET-DYEING METHOD AND APPARATUS

CROSS REFERENCE TO RELATED APPLICATION

This application is a division of Ser. No. 218,817 filed Dec. 22, 1980, now U.S. Pat. No. 4,416,124 issued Nov. 22, 1983.

FIELD OF THE INVENTION

The present invention relates to a sheet-dyeing method. More particularly this invention concerns a method for sheet-dyeing filaments with a dye like indigo.

BACKGROUND OF THE INVENTION

In the production of fabrics like denim it is necessary to dye the entire warp, that is all of the parallel filaments that will eventually be woven as the warp into the fabric, a relatively dark color. For blue denim a vat dye like indigo is used which is applied in several different stages to the filaments being dyed, alternating with drying or fixing stages during which the dye oxidizes to the desired blue color. Many different types of vat dyes require such multiple application alternating with a drying or fixing stage.

The classic system for carrying out this procedure, (see "Kontinuefarben von Baumwollkettgarn mit Indigo" by P. Richter in Textileveredlung 10 (1975) PP 313-317) takes all of the filaments used eventually to form the warp as bundles or cables each having 300–400 filaments. Each such cable or ball warp is up to 15,000 m long. A plurality of such cables, normally no more than twenty-four, are passed through a bath at between 30° C.–50° C. to wet them, and then the liquid is squeezed out of them and they are rinsed in cold water and again squeezed dry. Subsequently the ball warps are passed successively through between four and six different dye baths. On emerging from each of the dye baths the cable or strand is squeezed as dry as possible and is then subjected to a drying or gas-treatment stage.

The synthetic indigo dye is made water soluble in a chemically reducing bath. After having most of the dye squeezed out of the textile the textile dries with simultaneous oxidation of the dye which changes to the desired blue color and simultaneously becomes insoluble in water. In order to achieve the desired darkness it is necessary, as mentioned above, to repeat the dyeing and gas-treatment stages between four and six times. Thus such a standard dyeing system requires between four and six separate baths, each provided with its own pair of squeeze rollers and each having a separate gas-treatment rack.

After such multiple dyeing and drying the strand is washed, rinsed, brightened if necessary, and dried. The cables must then be painstakingly taken apart and the warp filaments rebeamed, an operation which is extremely laborious and time-consuming. Subsequently the rebeamed filaments are normally fed to a sizing machine, whereupon they can be employed as a warp beam in a weaving operation.

As a result of the thickness of the cable that is dyed and the inherent differences between the dye concentrations in the various baths it is obvious that the hue is going to vary somewhat from filament to filament and along each filament. Nonetheless the variations normally lie within a certain relatively narrow range so that when the filaments are rebeamed the color equalizes out over the fabric eventually produced. Indeed the slight variation often gives what is considered a desirable effect.

Obviously the disadvantage of this system is that the amount of equipment necessary for dyeing is extremely large. Six separate dyeing vats, each containing over 1000 liters of dye, must be provided, each with a respective pair of pinch rollers normally driven by a respective 5 kW motor. In addition each vat is associated with a separate drying rack comprised of a plurality of vertically offset rollers that guide the filaments through a vertically sinusoidal path, with the filaments engaging each roller over approximately 180°.

Operation of the system is relatively complex. First of all, the filaments of a given cable must all be under approximately the same tension. It is difficult to produce this simply by providing threadbrakes at the feed location, as that filament on the creel furthest from the takeup location will normally be tensioned substantially differently from that of the closest portion on the creel. If the tension is uneven a filament will break, normally winding itself about one of the guide rollers so that when that portion of the bundle about which is provided a temporary holding thread arrives at this roller the holding thread will normally be broken and at times the entire bundle ruined. Thus it is necessary for the operator of the machine to pay extremely close attention to its operation in order to shut it down at any time if a thread breaks and starts to wind around one of the guide rollers. When such an accident occurs the operation must be shut down, normally holding a portion of the cable under the dye too long and ruining at least one batch. Repair entails painstakingly threading the cable back through the extremely lengthy path it must follow in the machine.

A newer system is that of so-called sheet-dyeing. Here the filaments are all kept in a planar array, one next to the other, just as they would be used on the eventual warp beam. This type of strand is then passed in the same manner as the above-described cable through a plurality, normally between four and six, of different vats, each again provided with a respective pair of pinch rollers and drying rack. The advantage of this system is that the filaments remain in the position they will be in in the warp beam, so that the painstaking undoing of the cables and rebeaming of the filaments is avoided. Nonetheless this system has a considerable disadvantage that the dye hue is normally quite irregular in the finished product. This irregularity is normally manifested as longitudinal warp-wise stripes of lighter and darker colors in the dyed warp beam. Such stripes, if at all prominent, create an extremely undesirable effect in the finished goods, normally making them unacceptable for high-quality use.

The main cause of this irregularity has been traced to the inability of the pinch rollers to squeeze most of the dye uniformly out of the array of parallel filaments as they emerge from the dye. The layer is simply too thin for effective operation of the pinch rollers, one of which is normally a hardened steel cylinder and the other a hard rubber cylinder urged against it with several tons of force. Thus more dye is left on some filaments than on others, with the eventual above-discussed stripe effect.

A further development of this sheet-dyeing procedure has been to dye several such separate warps at the same time. This procedure increases the thickness of the multiple strand which passes through each of the set of pinch rollers, so that they can effectively reduce the liquid content thereof uniformly. Furthermore simultaneously dyeing two different warp beams at the same time substantially increases the output of a single dyeing installation, especially when the fact is taken into account that the painstaking formation of cables and rebeaming according to the older system is eliminated.

Even with this relatively efficient last-discussed system it is normally not possible to pass the filaments in the same production operation through a sizing machine. The main reason is that filament breakages are inevitable, and such filament breakages require that the machine be shut down at least temporarily. A warp beam cannot be held stationary in a standard sizing machine, so that it is normally necessary to wind each of the warp beams up on an individual beam, and then pass them separately through a sizing machine.

Furthermore this improved method requires that at least four and normally six baths each containing 1000 liters of dye be used. Each of these baths is consumed and must periodically have added to it, in the case of synthetic indigo, more dye, the chemicals which added with caustic soda reduce the dye to make it soluble, normally hydrosulphite, and the necessary surface active agents insuring proper penetration of the dye into the textile and further dispersing agents to maintain the suspension. Furthermore it is necessary to maintain the baths at a cooler temperature, normally below 20° C., as above this temperature the previously fixed dyes would be rereduced and dissolved. Furthermore temperature variations, like variations in chemical makeup of the bath, produce variations in hue. The classic variation is one from the head to the foot of the strand being dyed, normally a lightening hue from the head to the foot as the dye baths weaken and the temperatures increase.

Thus creating a uniform hue in a given batch is a relatively difficult operation requiring constant monitoring of bath composition, cooling of the bath composition, and removing of any foreign material carried by the strand into the baths. This problem normally requires that the textile be painstakingly washed before dyeing. What is more the dye exposed at the surface of the bath frequently oxidizes all by itself, creating another problem in weakening of the bath.

Thus it is normally possible only to use a speed of approximately 20 meters per minute through the bath if good dyeing is to be achieved. What is more the gas treatment, which is normally a simple drying although it can entail an active heating, radiation with ultraviolet or infrared light, or other operation in the air, must be uniform from vat to vat, that is the temperature and treatment at each of the fixing or drying racks must be identical. Simply put, operating such a system is extremely difficult, entailing keeping track of and controlling a great many variables all within a relatively narrow range. If if becomes necessary to change the hue substantially it is normally impossible to do so simply by redosing any of the baths. Instead all of the baths are normally dumped out and new batches of dye are made up. The amount of chemicals involved is extremely large, so that such discarding of four to six vats full of dye represents a considerable waste. Furthermore it is normally impossible to keep these dye baths for long periods of time, so that in the event of a holiday shutdown or the like all of the baths must be drained out and replaced at the end of the break.

Another disadvantage of the known system is that the considerable amount of liquid entailed creates a considerable pollution problem. The offensive chemicals, such as the caustic soda, in the dye vats cannot simply be discharged into a local sewer system. Instead complex treatment apparatus must be provided for the 4000 liters–6000 liters of dye liquid in each batch.

Another problem with the known system is that each of the drying racks normally has twelve deflecting rollers, creating 30 meters of path in the gas-treatment zone at the drying rack for each vat. Each of these rollers is engaged by the strand over about 180°, so that the contact between the strand and the great number of rollers is considerable. The likelihood of a filament breaking and winding up on one of these rollers is increased with the number of rollers and the amount of contact angle. Obviously with such a large system the possibility of such breakage and winding-up is great.

What is more the overall length of such a system is normally at least 40 meters. Each of the set of pinch rollers is operated, as mentioned above, by a respective 5 kW motor. The power consumption for such a large and complex system is therefore also relatively great.

OBJECTS OF THE INVENTION

It is therefore an object of the present invention to provide an improved method of dyeing a textile strand.

More particularly an object of this invention is the provision of a sheet-dyeing method which produces a more uniformly dyed product than any of the prior-art systems.

SUMMARY OF THE INVENTION

These objects are attained according to the instant invention in a sheet-dyeing method of the above-described type where the strand is conducted in at least two separate passes around an annular path having a first path section in a dye vat and a second path section in a gas-treatment location. The strand is contacted with a liquid dye in the same vat in each of the passes in the first path section and is treated with a gas in the same gas-treatment location in each of the passes of the second path location. Then the strand is directly passed through a washing and rinsing apparatus, and through a sizing apparatus to a warp beam.

The enormous advantage of this system is obviously that a single dye bath need be employed, along with a single drying rack. What is more the drive means, which is normally constituted by the pinch rollers that squeeze most of the liquid out of the strand immediately as it emerges from the vat, need not be duplicated for each pass of the strand through the dye bath.

According to this invention the strand is normally passed four times through the bath. Thus four different layers or plies of the strand can be squeezed out by a single set of pinch rollers, so that an extremely uniform dampness in the strand downstream of these rollers will be produced. It is within the scope of this invention, if four plies are too much, to use two separate sets of pinch rollers, one for two plies and another for another two plies. Nonetheless the plying of the strands insures that uniform squeezing-out of the dye will be effected.

As a result of the extreme simplification in the equipment according to this invention it is therefore possible to use a single bath holding the standard quantity of about 1000 liters of dye. Of course all of the standard monitoring equipment will be necessary to maintain the strength of this dye bath uniform, nonetheless the fact that only one set of such monitoring equipment need be provided, rather than six as in the prior art, represents an obvious saving. Furthermore since the strand passes each time through the same bath any of the above-described head-to-foot lightening in hue will be virtually impossible.

In fact the multiple passage through the same dye bath, which may occur between two and ten times according to this invention, is so very effective that normally only four passes are necessary to achieve the same hue with the same dyes as would be achieved in accordance with the prior-art systems by six different baths. What is more the use of a single bath makes variation in the hue from one batch to the other possible without discarding the bath. Instead the one bath is simply dosed with the appropriate chemicals to change it to produce the desired hue. Even if the bath must be disposed of, it represents a substantially smaller quantity of liquid that must be processed than any of the prior-art systems.

Furthermore it is possible to array the filaments over the same width they would assume in a finished piece of woven goods. Thus the strand according to this invention, which is comprised of a multiplicity of parallel and normally coplanar filaments, can be wound directly on the warp beam of a loom. From the single vat the strand passes directly through the washing and rinsing machines and then through the appropriate sizing machines, all directly to the warp beam. Thus a multiplicity of filaments go in one end of the system according to this invention and a dyed and sized ready-to-use warp beam is produced at the opposite end.

According to this invention the second path at the gas-treatment location is generally rectangular and lies generally in an upright plane perpendicular to the plane of the array of warp filaments and parallel to the direction of displacement thereof. The dyeing vat, supplies of yarn, and even a prewashing device if desired, may all lie within the annular path. As a result of this particular path shape each of the filaments engages any one of the deflecting rollers over which it passes over no more than approximately 90°. The likelihood of a thread breaking and winding up on a roller is therefore reduced, since the amount of contact between each filament and any of the guide rollers is also substantially reduced. The guide elements of the second path section can comprise at least two separate sets of second guides to define two separate second path subsections together constituting the second path section. The strand passes over one of the second path subsections on one pass and over the other second path subsection on the other pass, so that the separate passes do not contact each other over a distance, normally equal to between one-quarter and one-third of the whole second path length. The separation distance is normally between 10 m and 20 m, with the region of separation being above the ground by a distance of between 2 m and 4 m. Obviously although it is easier to squeeze out several plies of the strand, the strand nonetheless dries better when separated into its individual passes in the gas-treatment zone. Deflecting rollers can be provided along these path subsections so that the overall rectified length of the passes remains the same. Normally all of the passes except for one are reunited before they are reintroduced into the dye bath. The one pass that is not reintegrated with the others is sent on to the subsequent washing, rinsing, and sizing stage.

The system according to the instant invention can have an overall length of around 20 m as compared with the length of 40 m of most of the known systems. Only 16–18 deflecting rollers are needed instead of the 72 rollers that are normally implied, and these rollers are only engaged over 90° rather than 180°. Obviously only one bath rather than six is needed, along with a reduced amount of monitoring equipment to keep the dye solution in the bath at the appropriate strength. Disposing of the dye bath therefore becomes less of a problem, simply because there is less bath to deal with. Furthermore it is possible to increase the normal filament-advanced speed from between the standard 20 m/min to 30 m/min to approximately 35 m/min to 45 m/min. Thus the system not only is a substantially simpler than any other prior-art systems, but it allows a higher production speed.

The system according to the instant invention is particularly usable with cotton warp filaments that are to be dyed with vat dyes such as indigo for the production of blue denim. It can also be used for tinting warps of other material such as for example regenerated cellulose fibers, synthetic fibers, wool, or mixtures of these fibers. In addition the vat dyes used can include any dyes requiring a subsequent treatment in air, such as with simple air drying, infrared, or steam treatments. Such dyes include direct dyes, reactive dyes, acid-type dyes, or any of the specialized dyes for synthetic fibers. The system is merely to cover any type of dyeing operation where it is normally necessary to treat the strand being dyed several times, alternating the dye-contacting step with a step of fixing the dye outside the dye bath.

SPECIFIC DESCRIPTION

Figure 1A:
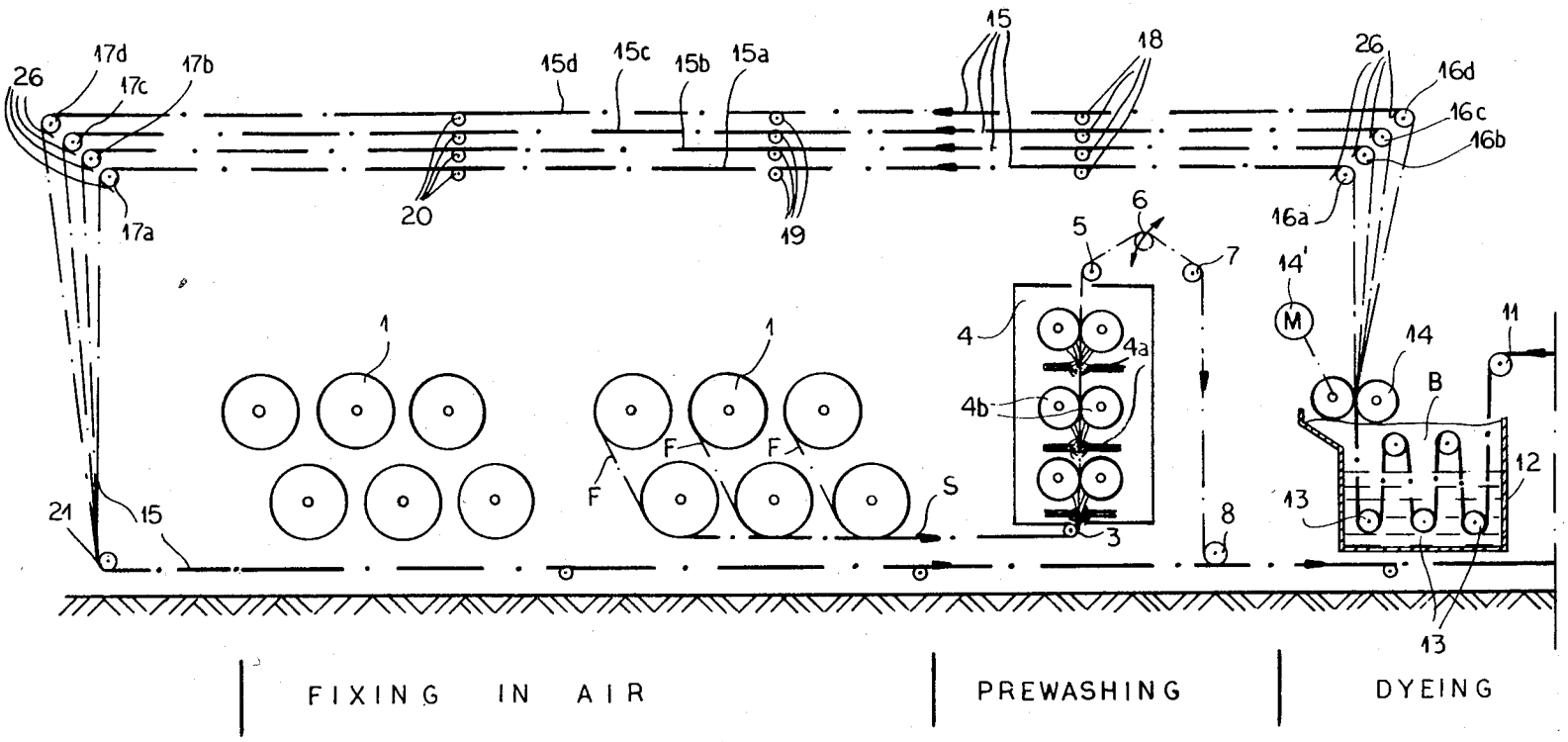
FIGS. 1*a* and 1*b* are respectively the left-hand and right-hand portions of a side view of a system according to the instant invention.
Figure 1B:
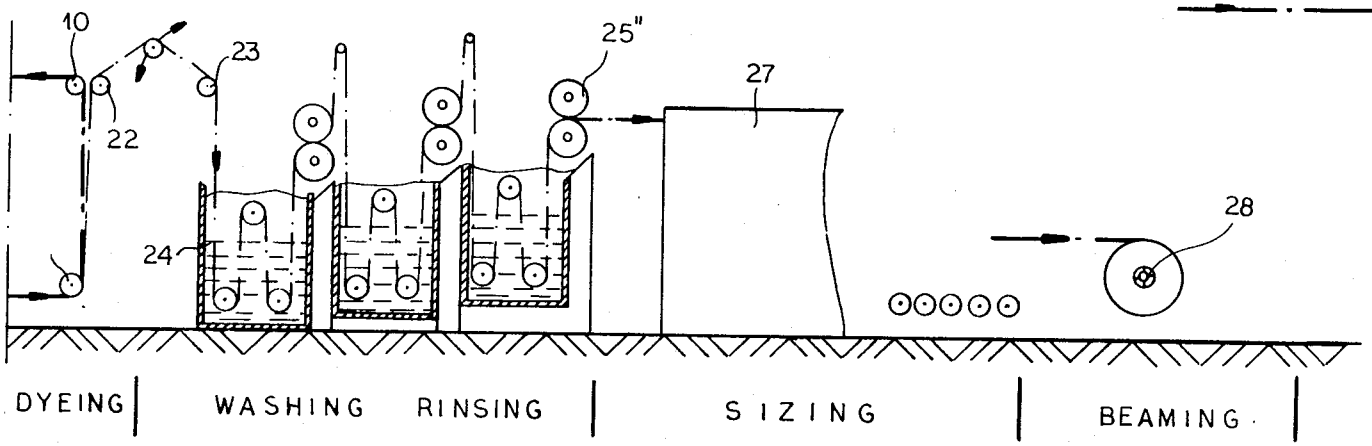
Figure 4A:
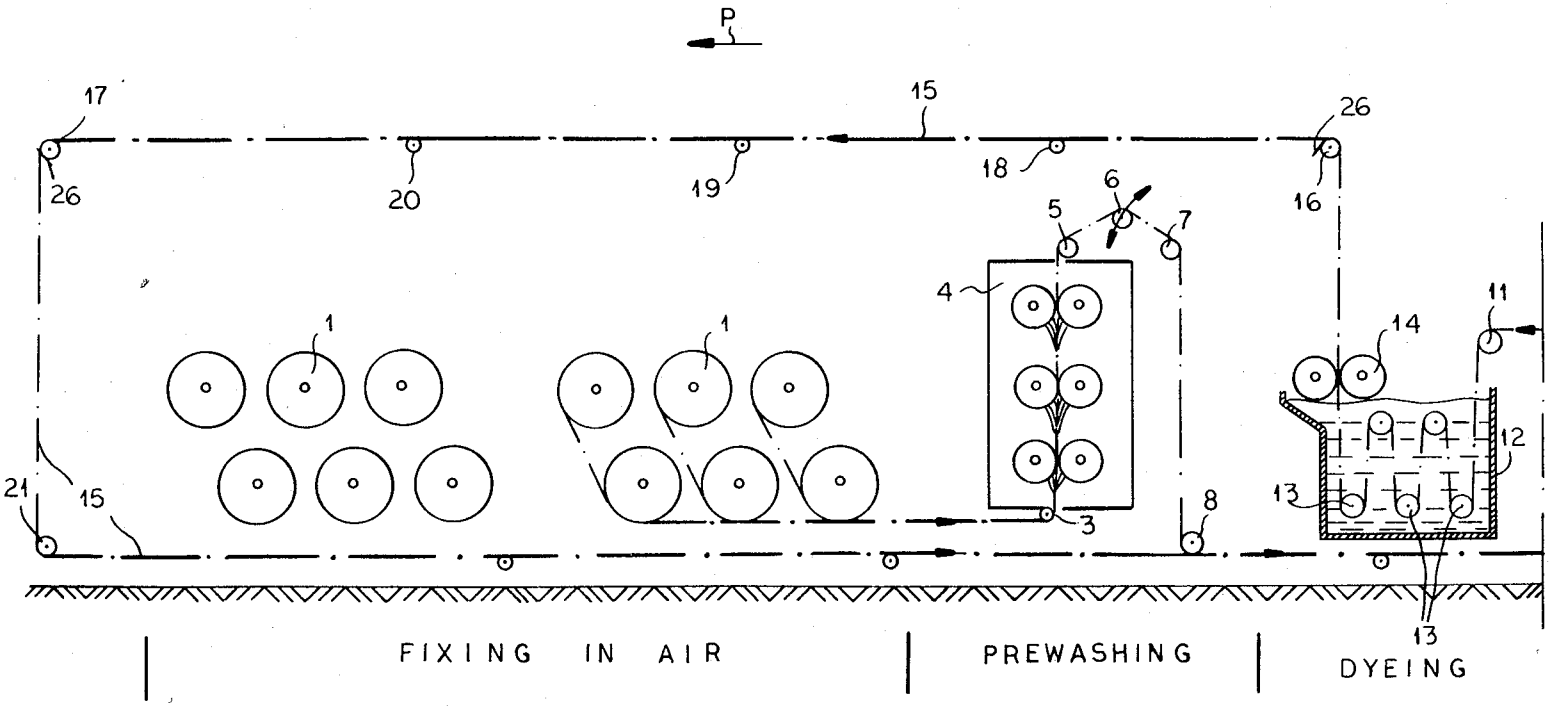
FIGS. 4*a* and 4*b* are views similar to FIGS. 1*a* and 1*b,* respectively, but showing another arrangement according to this invention.

As seen in FIGS. 1*a* and 1*b* a multiplicity of filaments F are pulled from a plurality of sectional beams 1 to form a main sheet strand S constituted of a multiplicity of parallel coplanar filaments F. This strand S passes over deflecting roller 3 and then up through a prewash tower having a plurality of sets of sprayers 4*a* alternating with pinch rollers 4*b* so that any dirt or the like on the filaments F is largely removed. The strand S passes upwardly out of the prewash tower 4 over a deflecting roller 5, a spring-biased tensioning roller 6, and another deflecting roller 7 down to a roller 8 where it is deflected to horizontal travel. Passage around three more deflecting rollers 9, 10, and 11 admits the strand S to a vat 12 containing five vertically staggered rollers 13 and a bath B of dye solution. In this bath B the strand S follows a sinusoidal course, passing back and forth over the rollers 13 until it emerges and is gripped by a pair of pinch rollers 14 one of which is driven by a motor 14*a* and is urged against the other roller with several tons of force. The strand S can then, as shown in FIG. 4*a,* pass upwardly over a single corner roller 16, and then over rollers 18, 19, and 20 to another corner roller 17. The rollers 16 and 17 define a horizontal stretch 15 in which the dyed strand S is exposed to the air so that a dye like indigo can oxidize and assume its blue color. The rollers 16 and 17 are associated with scrapers 26 that prevent any filament from winding up on them. The strand S is then deflected downwardly at the deflecting roller 17 over another deflecting roller 21, whence it passes forwardly again to the roller 9. At the roller 8 the strand S is plied with the strand emerging from the wash tower 4, and is then reintroduced into the bath B of the vat 12.

According to the instant invention the strand is plied four times so that, as indicated by the thickened line representing the strand, in the bath vat 12 and between the rollers 14 there are four plies of the strand S.

Figure 3:
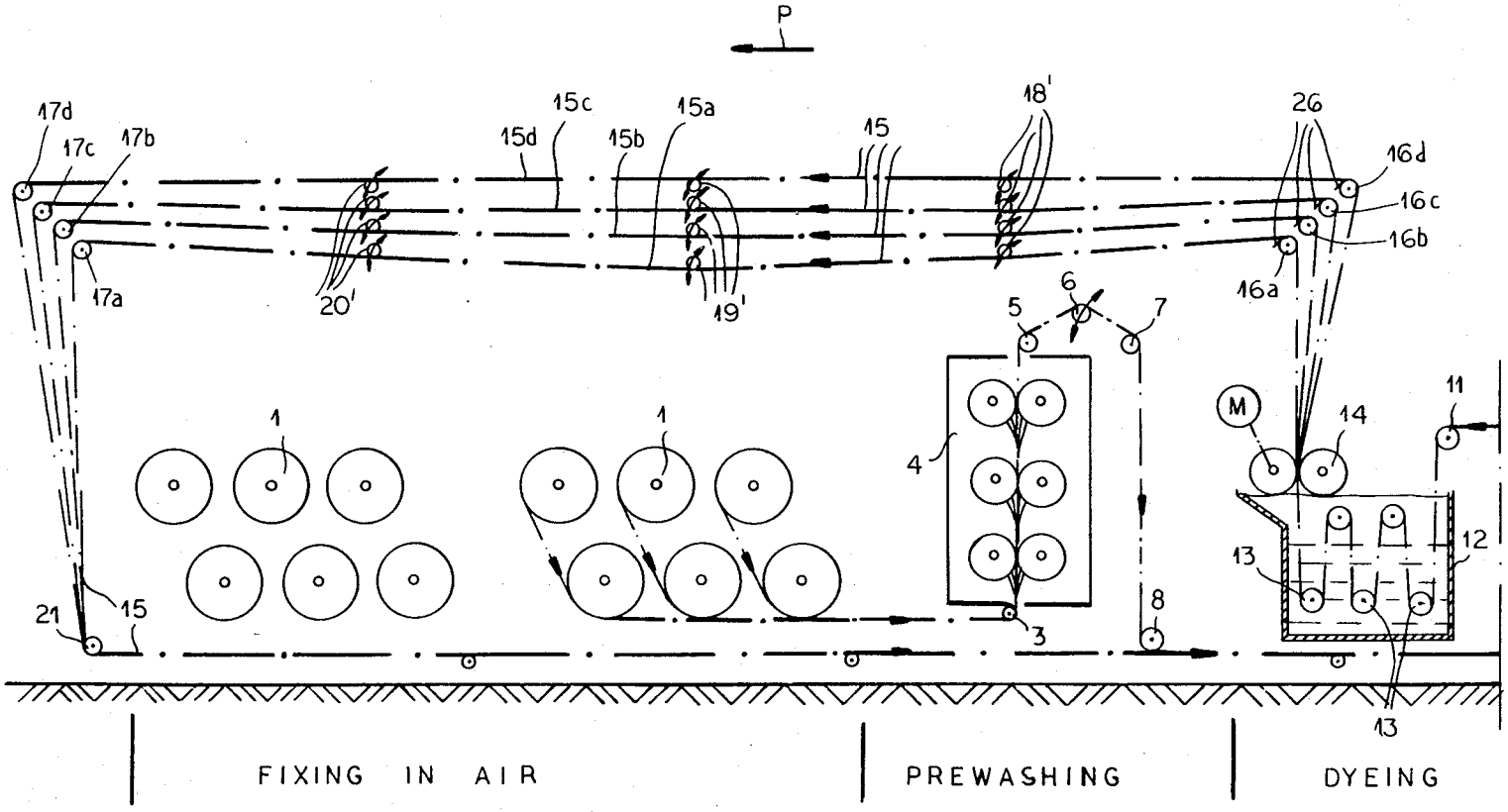
FIG. 3 is a view corresponding to FIG. 1*a* showing another system according to this invention.

It is possible as shown in FIGS. 1*a* and 1*b* to separate these plies as they emerge from the pinch rollers 14 and pass them over respective deflecting rollers 16*a*–16*d* and 17*a*–17*d*, forming separate stretches 15*a*–15*d* which are out of contact with one another. Thus in this region the separate plies are separated from one another for best oxidation and drying. The overall height of the stretches 15*a*–15*d* above the ground is between 2 m and 4 m and the overall length between the rollers 16*a*–*d* at one end and 17*a*–*d* at the other end is between 10 m and 20 m. It is also possible as shown in FIG. 3 to provide deflecting rollers 18', 19', and 20' which are not arranged in perfect planes so that the overall lengths of the paths formed by the various passes of the strand S are all equal.

After the fourth go-around, the strand S passes over the roller 9 and then passes up to a deflecting roller 22 adjacent the roller 10, then over tension roller 22*a* and over another deflecting roller 23 whence it passes into three subsequent washing and rinsing stages 24, 24', and 24'' of standard construction and each having a respective set of pinch rollers 25, 25', and 25''. Then the strand is sized in a standard sizing installation 27 and wound up on a beam 28.

Figure 2:
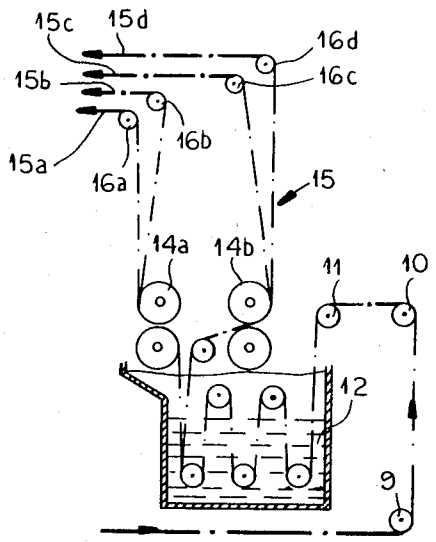
FIG. 2 is a side view of a detail of a variation on the apparatus of FIGS. 1*a* and 1*b;*
Figure 5:
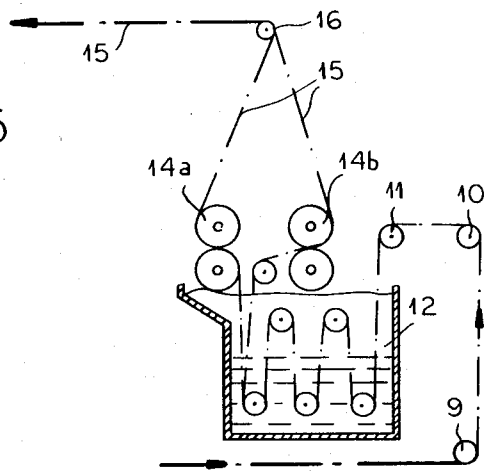
FIG. 5 is a view similar to FIG. 2 showing a variation on the system of FIGS. 4*a* and 4*b.*
Figure 4B:
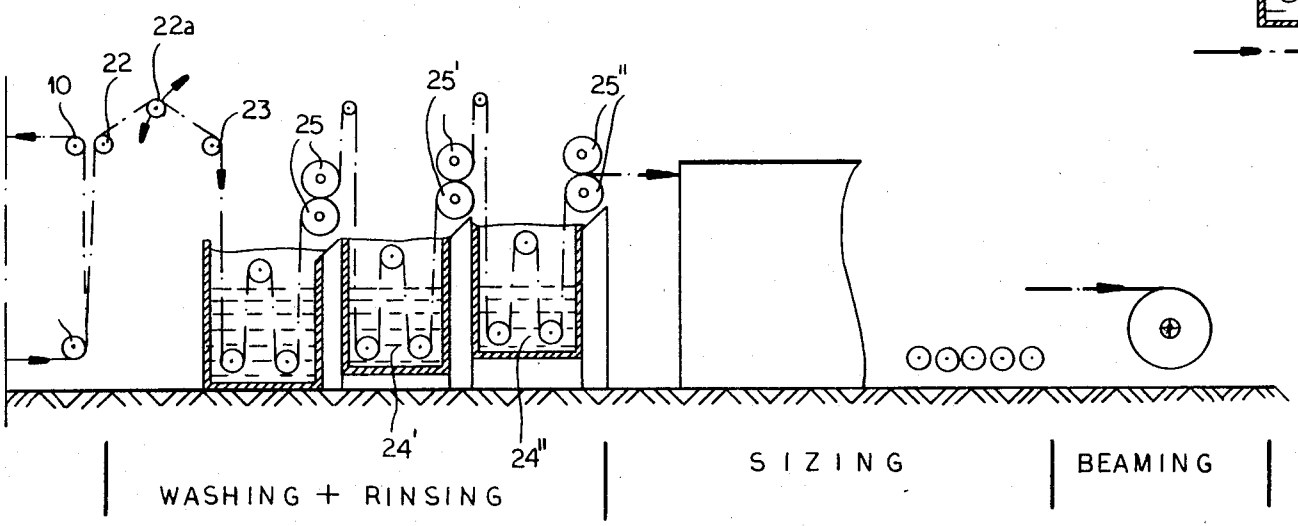

It is also possible as shown in FIG. 2 to separate the four plies emerging from the vat 12 between two sets of pinch rollers 14*a* and 14*b* like the rollers of 14, and then to feed them over the respective upstream guide rollers 16*a*–16*d*. FIG. 5 shows a similar such arrangement, but wherein the plies are united at a single roller 16.

Each of the sectional beams 1 carries between 660 and 680 filaments of raw cotton each about 12,000 m long. Thus the strand S has approximately 4000 individual filaments. The bath B has a reducing agent such as sodium hydrosulphite ($Na_2S_2O_4$) along with caustic lye that solublizes the vat dye, here indigo. In addition the bath B contains dispersing and bonding agents. This bath B is yellow, but the strand S turns the desired blue color as it oxidizes in the second path section 15 as it moves along in direction P through a distance of approximately 30 m. The entire batch can be processed in approximately 10 hours, conveniently corresponding to approximately the length of one shift. The machine can have an overall length of approximately 20 m, compared to approximately 40 m for the standard six-bath machines, assuming a rectangular annular path 15 having a rectified length of approximately 30 m. Furthermore only approximately 12001 of bath are needed for the entire process, as compared to between 4001 and 6001 for the standard prior-art systems. The motor 14' for the rollers 14 can be a single 10 kW motor, as compared to the 5 kW motors normally employed in a 6-bath system. What is more if the dyeing is to be extremely intense, it is relatively easy to adapt a system according to this invention for up to ten passes through the vat 12 without substantially changing the overall arrangement.

Below are given several examples of dyeing processes according to the instant invention.

EXAMPLE I

Cotton wool of a thread number Ne6 is dyed with the following dye mixture:

6 g/l indigo dye (BASF 98%),
15 ml/l caustic soda 50%,
5 g/l sodium hydrosulphite, and
2 g/l "Primasol FP" (BASF bonding agent).

The thread is passed from six sectional beams each carrying 632 filaments to form a strand 160 cm wide that is advanced at about 40 m/min through the apparatus. The temperature of the dye is maintained by appropriate cooling, since the dyeing reaction is exothermic, at 20° C.

After squeezing the excess dye the strand is oxidized for about 60 seconds over a path 15 approximately 40 m long. The dyeing process, squeezing-out, and air-treatment or oxidation step are repeated four times. After the fourth oxidation process the outermost strand is washed, rinsed, dried in a cylinder dryer, and then sized and wound up on a beam.

EXAMPLE II

The sheet strand of example I is used, but with a direct-dye of the following composition:

10 g/l "Siriuslichtrot" F 3 B 200 (Bayer),
0.5 g/l Soda calc., and
2 g/l "Erkantol PAD" (Bayer bonding agent).

After soaking and squeezing-out the sheet strand is passed through a steam tunnel with saturated steam is approximately 102° C. This process is then repeated six times. The total fixing time adds up to 120 seconds.

After the sixth passage through the steam tunnel the outermost sheet strand is stripped off, washed, dried, sized, and rebeamed. The last rinse is a hot one with a salt solution. Once again all of the steps are run continuously.

EXAMPLE II

A sheet strand of a mixture of raw cotton and regenerated cellulose fiber in equal parts of thread Ne9 is passed through a 15° C. dye both comprising the following:

10 g/l "Levafixbrillantblau PRL" (Bayer),
150 g/l urea,
5 g/l Soda calc., and
10 g/l "Ludigol" (BASF Reduction Preventer).

The yarn is pulled off of six sectional beams each carrying 690 individual filaments to form a sheet strand of 160 cm width. As in Example I the strand, once the excess dye is squeezed out of it, is passed through a steam tunnel with saturated steam at approximately 102° C. This procedure is repeated three times so that the overall fixing time is approximately 60 seconds. The result in color is as rich as if a concentration three times as strong of the dye were originally used with a single dipping.

I claim:

1. A method of dyeing a strand which comprises the steps of:

(a) passing said strand consisting of a plurality of parallel filaments along a first linear horizontal path portion and then into a dyeing bath at the end of said first horizontal path portion;

(b) within said bath passing a multiplicity of lengths of said strand jointly back and forth in contact with said bath until said lengths jointly emerge from said bath in a planar array formed by plied strands;

(c) squeezing said planar array of plied strands upon its emergence from said bath between a pair of rollers;

(d) subjecting the lengths of said strand upon their emergence from said rollers to a separation from their common plane and then guiding said separated lengths along parallel linear horizontal paths in vertically spaced relationship;

(e) combining the separated lengths of said strand at the ends of said paths in vertically spaced relationship again into a planar array and feeding the combined lengths of plied strand in a further planar array horizontally;

(f) joining the horizontally displaced combined lengths of the last mentioned array with the strand along said first horizontal path portion for passage therewith into said bath; and (g) treating the strand along the vertically spaced horizontal paths with a gas.

* * * * *